US005605296A

United States Patent [19]

Haasen et al.

[11] Patent Number: 5,605,296

[45] Date of Patent: Feb. 25, 1997

[54] METHOD AND APPARATUS FOR WINDING A YARN

[75] Inventors: Rolf Haasen, Mönchengladbach; Hans-Günter Wedershoven, Im Loewinkel, both of Germany

[73] Assignee: W. Schlafhorst AG & Co., Monchen-Gladbach, Germany

[21] Appl. No.: 530,613

[22] Filed: Sep. 20, 1995

[30] Foreign Application Priority Data

Sep. 28, 1994 [DE] Germany ..... 44 34 610.7

[51] Int. Cl.[6] ..... B65H 69/04; B65H 63/00

[52] U.S. Cl. ..... 242/35.6 E; 242/36

[58] Field of Search ..... 242/35.6 R, 35.6 E, 242/36, 37 R, 18 R

[56] References Cited

U.S. PATENT DOCUMENTS

| | | | |
|---|---|---|---|
| 3,198,446 | 8/1965 | Furst et al. | 242/35.6 R |
| 3,539,122 | 11/1970 | Spani | 242/36 |
| 3,728,550 | 4/1973 | Cleland, Jr. et al. | 242/35.6 E X |
| 4,535,945 | 8/1985 | Rohner et al. | 242/35.6 R |
| 4,957,244 | 9/1990 | Colli et al. | 242/35.6 R |
| 5,188,304 | 2/1993 | Colli et al. | 242/35.6 R |
| 5,301,886 | 4/1994 | Kathke et al. | 242/35.6 R |

*Primary Examiner*—Michael R. Mansen
*Attorney, Agent, or Firm*—Shefte, Pinckney & Sawyer

[57] ABSTRACT

A method and apparatus for correcting an interruption of yarn travel resulting in a trailing yarn end from a take-up bobbin and a leading yarn end from a feed bobbin, wherein after the interruption of yarn travel, the take-up bobbin is braked to a stop and a sensor detects the absence of the trailing yarn end from the take-up bobbin. If the absence is detected, the take-up bobbin is rotated in the take-up direction until the trailing yarn end is wound onto the take-up bobbin. If the absence is not detected, it is assumed that the trailing yarn end is wound onto the take-up bobbin. A catcher nozzle is provided for aspirating the trailing end if it is not wound onto the take-up bobbin, and the sensor is associated with the catcher nozzle. A suction nozzle is provided for aspirating the yarn end from the peripheral surface of the take-up bobbin and placing the trailing yarn end in a yarn end joining device where it is joined to the leading yarn end.

7 Claims, 5 Drawing Sheets

METHOD AND APPARATUS FOR WINDING A YARN

FIELD OF THE INVENTION

The present invention relates to a method and apparatus for winding a yarn at the winding station of a bobbin winding machine from a feed bobbin to a take-up bobbin, in which upon a yarn break or other interruption of yarn travel the take-up bobbin is stopped and rotated briefly in its takeup (i.e. winding) direction, and in which the yarn end trailing from the take-up bobbin is then aspirated by means of a pivotable suction nozzle from the circumferential surface of the take-up bobbin while rotating in the unwinding direction and is placed in a device for splicing or otherwise joining the aspirated yarn end to the yarn end from the feed bobbin in order to restore yarn travel.

BACKGROUND OF THE INVENTION

In the winding of a yarn, problems always arise if yarn travel is interrupted. There are three possible ways by which yarn travel can be interrupted. First, the feed bobbin may run empty once the trailing end of the yarn has been wound onto the take-up bobbin. The absence of the feed yarn is discovered at the latest whenever an attempt is made to aspirate the yarn end of the feed bobbin for a yarn end joining operation in order to restore yarn travel. The second possibility for yarn interruption is that a so-called yarn cleaner, that is, a sensor for monitoring the yarn quality that has a cutting device, cuts the yarn when a flaw appears in it. After the cut is made, the yarn end upstream of the cut generally is wound onto the take-up bobbin, while the downstream yarn end associated with the feed bobbin is initially clamped in the cutting device until, during the aspiration of the lower yarn by the so-called gripper tube, the cutting and clamping device and a yarn tensioner are opened. The third possibility of interruption of yarn travel is breakage of the yarn because of a yarn flaw. Such a yarn break can occur anywhere in the course of the yarn between the feed bobbin and the take-up bobbin. If a yarn breaks above the cleaner, then as a rule the upstream length of yarn traveling to the take-up bobbin is wound onto the take-up bobbin. The yarn end extending from the feed bobbin is normally aspirated by a so-called catcher nozzle, which is disposed above the cleaner.

To restore the yarn travel, it is known to utilize a suction nozzle which is brought to the take-up bobbin to aspirate the yarn end trailing therefrom, while a catcher nozzle holds the yarn end of the feed bobbin. Both yarn ends are placed in a yarn end joining device for splicing or knotting the two yarn ends in a known manner thereby to restore yarn travel.

If an interruption in yarn travel occurs from one of the three reasons given above, the take-up bobbin is first brought to a standstill in the shortest possible time. Thereafter, the take-up bobbin is again driven for a few revolutions in the windup direction. In this manner, the yarn end trailing from the take-up bobbin will also actually be wound onto the take-up bobbin, particularly in take-up bobbins with a small diameter having a few layers of yarn first wound onto it, whereby the yarn end can later be aspirated by the suction nozzle.

In take-up bobbins that already have a number of layers of yarn and thus a correspondingly larger diameter, it typically occurs naturally that the inertial mass and the large circumference of the bobbin causes the yarn end to be deposited entirely on the circumference of the take-up bobbin as it slows to a standstill.

With heavy bobbins, restarting the winding process requires an increased expenditure of energy. Moreover, it is not advantageous for the yarn layers if a heavy bobbin is again accelerated from a stop, for a brief time and only for a few revolutions, and shortly thereafter is braked to a stop again. Likewise, restarting the winding process for a short time represents a loss of time. Nevertheless, these take-up bobbins are likewise first driven for several revolutions in the winding direction before the yarn end joining operation.

German Patent Document DE 32 25 379 A1 (which corresponds to U.S. Pat. No. 4,535,945) is representative of the above-described state of the relevant art.

SUMMARY OF THE INVENTION

It is therefore an object of the present invention to provide an improved method and apparatus operative if interruptions in yarn travel occur to increase the effectiveness of the yarn end joining operation and at the same time to avoid faulty handling.

This object is achieved in accordance with the present invention by providing a method of correcting an interruption of yarn travel during winding a yarn at a winding station of a bobbin winding machine from a feed bobbin to a take-up bobbin rotating in a take-up direction, wherein the interruption results in a trailing end of yarn from the take-up bobbin and a leading yarn end from the feed bobbin. According to the present method, the take-up bobbin is initially stopped and, at the same time, the absence of the trailing yarn end on the peripheral surface of the take-up bobbin is sensed. If the trailing yarn end is detected to be absent from the surface of the take-up bobbin, then the take-up bobbin is rotated briefly in the take-up direction to wind the trailing yarn end onto the peripheral surface of the take-up bobbin. Alternatively, the rotation of the take-up bobbin in the take-up direction is suppressed or stopped if the absence of the trailing yarn end on the peripheral surface of the take-up bobbin is not sense. The trailing yarn end from the peripheral surface of the take-up bobbin is aspirated by means of a pivotable suction nozzle, while the take-up bobbin is rotated opposite to the take-up direction and the aspirated trailing yarn end is placed in a yarn end joining device for joining with the leading yarn end from the feed bobbin in order to restore yarn travel.

Preferably, the present method provides for the transmitting of a yarn-absent signal upon sensing the absence of the trailing yarn end on the peripheral surface of the take-up bobbin and generating a yarn-present signal after a predetermined time during which no yarn-absent signal is transmitted. To initiate the correction of an interruption in yarn travel, the suction nozzle is moved from a retracted position toward the peripheral surface of the take-up bobbin while the take-up bobbin is rotated opposite the take-up direction so that the suction nozzle can aspirate the trailing yarn end. A sensor is activated for ascertaining the presence or absence of the trailing yarn end. The moving position of the suction nozzle is monitored relative to the take-up bobbin and, if necessary, the take-up bobbin is again rotated in the take-up direction within a predetermined period of time.

The present invention also provides an apparatus for winding a yarn at a winding station of a bobbin winding machine from a feed bobbin onto a take-up bobbin rotating in a take-up direction, with appropriate means for correcting an interruption in yarn travel resulting in a yarn end trailing from the take-up bobbin and a yarn end leading from the feed bobbin in accordance with the described method.

Basically, the correcting means comprises a movable suction nozzle for aspirating the trailing yarn end from the take-up bobbin and for placing it in a yarn end joining device for joining it to the leading yarn end from the feed bobbin in order to restore yarn travel, a catcher nozzle for aspirating one end of a broken yarn, a sensor associated with the catcher nozzle for detecting the presence of the trailing yarn end within the catcher nozzle, thereby to indicate the absence of the trailing yarn end on the peripheral surface of the take-up bobbin, and a control means operable after a yarn interruption for controlling the direction of rotating of the take-up bobbin as a function of the detection of the trailing yarn end by the sensor. Preferably, the catcher nozzle and the movable suction nozzle are joined at a junction leading to a common connection to a negative pressure supply, and the sensor is located downstream in the suction direction from the junction.

Thus, upon an interruption in yarn travel, the take-up bobbin is initially stopped. According to the invention, a sensor is then activated in order to ascertain the absence of the yarn end on the take-up bobbin, such sensor preferably being located in the negative pressure supply of the bobbin winding machine downstream (in the suction direction) of the united portion of the catcher nozzle and the suction nozzle through which the trailing yarn end from the circumferential surface of the take-up bobbin is aspirated for subsequent placement of the yarn end in the yarn end joining device.

If the sensor does not detect any yarn end, then it can be assumed that the yarn end trailing from the take-up bobbin has run onto the take-up bobbin. Hence, the command for briefly rotating the take-up bobbin in the winding direction is then suppressed. However, if the sensor detects a yarn end thereby indicating that the trailing end from the take-up bobbin is not wound onto its circumferential surface, then the take-up bobbin is again briefly driven in the winding direction in order to wind up the yarn end.

The yarn catcher nozzle is disposed above a cutting device of a yarn cleaner. After a yarn break, the catcher nozzle normally aspirates the leading end of yarn from the feed bobbin. The feed yarn is firmly held with the aid of the suction that is constantly present in the catcher nozzle, until the yarn severing knife of the cutting device cuts the yarn to initiate the yarn end joining operation. Simultaneously, the yarn is clamped by means of a clamp. The cut-off part of the lower yarn is then aspirated through the catcher nozzle for disposal.

If there is a yarn flaw, the yarn travel is interrupted by actuation of the cutting and clamping device, and the leading end of yarn coming from the feed bobbin is clamped after the severing cut, while the yarn end trailing from the take-up bobbin continues toward the take-up bobbin to be wound up by it in the normal manner.

If the sensor detects a yarn end after an interruption in yarn travel, especially after a severing cut has been made, then the detected yarn end can only originate from the take-up bobbin and must have been aspirated by the yarn catcher nozzle as a result of the trailing length of yarn from the take-up bobbin having not been wound up properly. Only in that case is it necessary in accordance with the present invention to drive the take-up bobbin briefly in the winding direction. To assure that the yarn in such case will be wound up completely onto the take-up bobbin, the take-up bobbin must be rotated long enough that the yarn can travel at least the distance from the sensor to the periphery of the take-up bobbin. As a rule, additional revolutions are also accomplished for safety's sake. Given the varying diameter of take-up bobbins, it can take a longer or shorter time for the yarn to be completely pulled out of the yarn catcher nozzle, and therefore the number of revolutions required is determined by the winding roller. The number of revolutions of the winding roller assures that regardless of the diameter of the take-up bobbin, a yarn end aspirated into the yarn catcher nozzle will be pulled completely out of it and wound onto the take-up bobbin.

Until this yarn end has been entirely wound onto the circumferential surface of the take-up bobbin, it is not possible for this yarn end to be removed from the circumferential surface of the take-up bobbin with the suction nozzle. Conversely, if the yarn end has been aspirated by the catcher nozzle, then as a rule that yarn end is located in the placement grooves of the winding roller and is therefore inaccessible to the suction nozzle.

After an interruption in yarn travel, the situation can also occur where the yarn end being wound onto the take-up bobbin is caught by the catcher nozzle but has not been aspirated inward sufficiently that it becomes detectible by the sensor. It is also possible for the yarn end still to be hanging freely down from the winding roller without having reached the yarn catcher nozzle. In such cases, the sensor signals that it does not detect any yarn end, and the conclusion must therefore be drawn that the yarn end is already wound on the circumferential surface of the take-up bobbin. In turn, the suction nozzle is pivoted in the direction toward the take-up bobbin in order to retrieve the upper yarn for a yarn end joining operation. At the same time, the take-up bobbin is driven in the unwinding direction. If the situation then occurs that at a certain position of the suction nozzle after a certain period of time within which the suction nozzle has been pivoted from its starting position the yarn is detected by the sensor, then according to the invention the unwinding of the yarn from the take-up bobbin is immediately stopped. From the number of revolutions of the winding roller moving in reverse, it can be determined that the yarn end of the take-up bobbin had been aspirated by the yarn catcher nozzle and accordingly had not been wound onto the take-up bobbin.

By driving the take-up bobbin in the unwinding direction in the case described above, a yarn not yet wound onto the take-up bobbin always continues to be aspirated by the yarn catcher nozzle. Because the yarn is still located in the yarn guide grooves of the winding roller, it is not reachable by the suction nozzle. Thus the take-up bobbin is stopped if the yarn end is first detected as the suction nozzle is being moved toward the take-up bobbin. That is, if a yarn end is detected by the sensor before the suction nozzle is in contact with the circumferential surface of the take-up bobbin, then it must be concluded that the yarn took some other path than that through the suction nozzle. Since the length of the suction nozzle produces a yarn path through the suction nozzle which is longer than the path through the yarn catcher nozzle, a reliable distinction can be made as to whether the yarn end has been aspirated by the catcher nozzle or by the suction nozzle.

If the sensor accordingly determines after a predeterminable time during the driving of the take-up bobbin in the unwinding direction that a yarn end has been aspirated, but the suction nozzle has not yet reached the peripheral surface of the take-up bobbin, then the take-up bobbin is stopped and driven in the winding direction. This rewinding of the yarn takes place within a predeterminable period of time, which is at least long enough that the yarn aspirated by the catcher nozzle is entirely wound onto the take-up bobbin.

The time can be specified for instance as a function of the bobbin diameter, so that even with take-up bobbins that are first made up of a few layers of yarn, the yarn can be reliably pulled out of the catcher nozzle and wound onto the take-up bobbin.

Not until it is assured that the yarn end has been completely wound onto the take-up bobbin can the yarn end joining operation be continued. Compared with the conventional method for winding a yarn, the method according to the invention has the advantage that it is possible after a yarn interruption to ascertain whether the yarn end on the takeup side has been wound onto the take-up bobbin, and, in turn, whether a yarn end joining operation can then be performed at all. If the sensor in the suction line ascertains that there is no yarn end present, then the rotation of the take-up bobbin in the winding direction after being braked to a standstill can be omitted. A yarn end that is already located on the circumferential surface of the take-up bobbin is thus not forced even farther into the upper yarn layers. However, if the sensor does detect a yarn end, then depending upon the position of the suction nozzle, the take-up bobbin is driven in the winding direction, in order to pull a yarn end out of the catcher nozzle and wind it onto the take-up,bobbin so that this yarn end can be aspirated by the suction nozzle. A yarn end that has been aspirated by the catcher nozzle would, by the conventional winding method, not be graspable for aspiration by the suction nozzle.

DESCRIPTION OF THE PREFERRED EMBODIMENT

Figure 1:
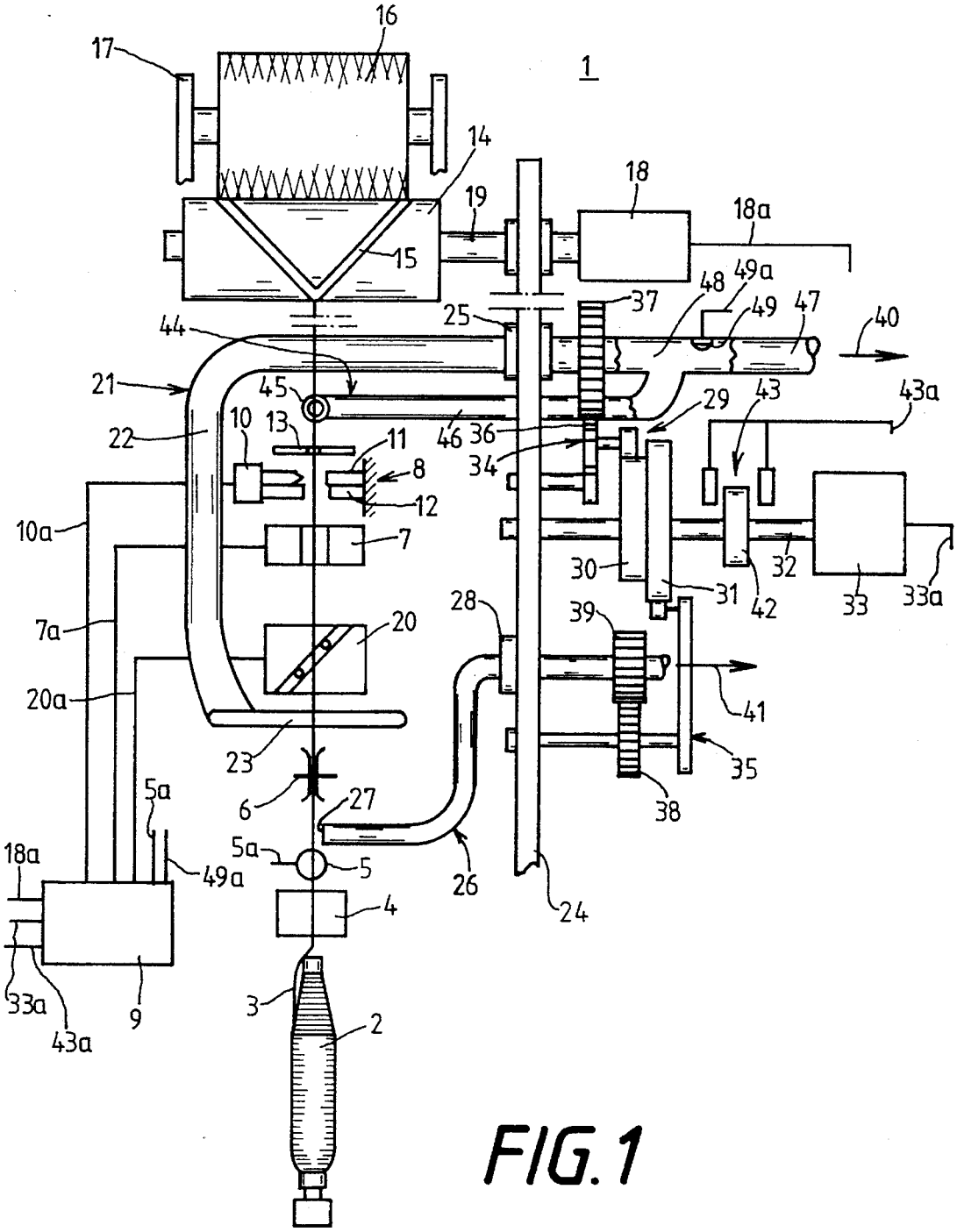
FIG. 1 is an elevational view of a winding station in accordance with the present invention during unimpeded winding operation.

Referring now to the accompanying drawings, FIG. 1 shows the winding station 1 of a bobbin winding machine (not otherwise shown). Only those characteristics of the winding machine and winding station required for understanding the present invention are shown and described.

A yarn 3 is drawn from a feed bobbin 2 that is supported in a feeding position. The yarn 3 travels through a draw-off accelerator 4 and past a lower yarn sensor 5 through a yarn tensioner 6 and a so-called electronic yarn cleaner 7 that has a sensor for monitoring the presence and quality of the yarn. Above the yarn cleaner 7, the yarn passes through a cutting and clamping device 8. A yarn guide 13 is located above the cutting and clamping device 8 forming a starting point from which begins the shogging or traversing of the yarn 3 by the action of the winding roller 14 by means of the yarn guide grooves 15 in such roller for depositing the yarn in cross-wound layers onto a take-up bobbin 16 carried by a creel 17 in peripheral surface driven engagement with the winding roller 14. The winding roller 14 is driven by a motor 18 via a shaft 19. Also located in the path of yarn travel is a yarn end joining device 20, which by way of example is a pneumatic splicer.

If the yarn cleaner 7 ascertains an unacceptable yarn flaw, then the cutting and clamping device 8 is actuated. The yarn flaw is reported to the control unit 9 of the winding station 1 by the yarn cleaner 7 over the signal line **7*a*. The control unit thereupon, via the control line 10*a*, issues a command to the actuating device 10 of the cutting and clamping device 8. While the cutting element 11 cuts the yarn, the yarn end coming from the feed bobbin 2 is clamped by the clamping element 12. The yarn end trailing from the take-up bobbin 16 normally continues to be wound onto the take-up bobbin 16**.

The winding station 1 also has two yarn feeders i.e., suction nozzle 21 and gripper tube 26. If a yarn break occurs or a severing cut is made because a yarn flaw has been found, one of the yarn feeders, namely, the suction nozzle 21, serves to look for the yarn end on the take-up bobbin 16 and then to place it in the yarn end joining device 20. This yarn feeder is a so-called suction nozzle 21 which comprises a tube 22 with a flat aspiration opening 23 having the same width as a cross-wound bobbin or cone. The tube 22 is rotatably supported in a swivel joint 25 in the wall 24 of the winding station 1. In a retracted position of repose as depicted in FIG. 1, the aspiration opening 23 of the suction nozzle 21 is located above the yarn tensioner 6 and below the yarn end joining device 20. The pivoting range of the suction nozzle 21 spans the so-called yarn cleaner 7 and the cutting and clamping device 8.

A so-called gripper tube 26 similarly serves as a yarn feeder for grasping the yarn end from the feed bobbin 2. In its retracted position of repose, the aspiration opening 27 of the gripper tube 26 is located laterally beside and behind the extent of the yarn 3 between the draw-off accelerator 4 and the yarn tensioner 6. The gripper tube 26 also comprises a tube that is supported in a swivel joint 28 in the wall 24 of the winding station 1.

The actuation of the yarn feeders is effected, in the present exemplary embodiment, by means of cam disks. With the aid of a package of cam disks, the functions of the winding station 1 in the production of a yarn end joint or splice are controlled. In the present embodiment, only two cam disks 30 and 31 of the cam disk packet 29 are shown, these disks controlling the motion of the suction nozzle 21 and the gripper tube 26 respectively. The cam disks are mounted on a shaft 32, which is supported in the wall 24 of the winding station 1 and is driven by a motor 33. The motor 33 is connected to the control unit 9 via the control line **33*a***.

Also schematically shown in the exemplary embodiment is the actuation of the yarn feeders by means of cam levers 34 and 35. The cam lever 34 is supported at one end in the wall 24 of the winding station and at the other end rests on the cam disk 30. By means of a toothed quadrant 36, the cam lever 34 engages a gear wheel 37 on the tube 22 of the suction nozzle 21 extending through the wall 24. The cam lever 34 is deflected outward to pivot reciprocably in the manner of a crank more or less depending on the profile of the cam disk 30. By means of a spring (not shown), the cam lever 34 is pressed against the cam disk 30. By means of the toothed quadrant 36, the pivoting motion of the cam lever 34 is transmitted to the engaged teeth of the gear wheel 37 on the suction nozzle 21. Thus, the swiveling motions of the cam lever 34 are thus converted into opposite swiveling motions of the suction nozzle 21. The gripper tube 26 is also actuated in the same manner. The cam lever 35, which is likewise supported in the wall 24 of the spinning station, is pressed against the cam disk 31 by means of a spring (not shown) and is deflected in accordance with the shaping of the disk 31. The cam lever 35 also has a toothed quadrant 38, which meshes with a gear wheel 39 on the gripper tube 26 whereby the motion of the cam lever 35 is transmitted to the gripper tube 26 in the opposite direction.

Valves (not shown) control the application of suction to the aspiration openings 23 and 27 of the suction nozzle 21 and gripper tube 26 respectively and can be controlled as a function of the position of the yarn feeders. The suction force, symbolized by the arrows 40 and 41, serves to aspirate the yarn ends after a yarn interruption and keep the yarn ends taut during their placement in the yarn end joining device 20. After placement of the yarn ends, the yarn end joining device, preferably a pneumatic splicer 20 in the present exemplary embodiment, is actuated via the control line 20*a*. The remnants of the yarn ends severed as part of the splicing operation are removed by suction from the aspiration openings of the yarn feeders.

The positions of the cam disks 30 and 31 and thus the positions of the yarn feeders are ascertained in the present exemplary embodiment by means of incremental position measurement. To that end, an incremental signal encoder 42 is placed on the shaft 32 that drives the cam disk packet 29. In the present exemplary embodiment, this encoder is a disk with a grid of fine lines that is scanned with a reading device 43. Depending on the angular position of the shaft 32, the disk 42 with the grid of fine lines is rotated, and a certain number of fine lines, which number is associated with a certain angular position of the disk, is recorded by the reading device 43 as a result. On the basis of the ascertained angular position of the disk 42, a conclusion can be drawn as to the position of the yarn feeder. The reading device 43 is connected to the control unit 9 over a signal line 43*a* and reports to it the number of increments recorded at any time, as a result of which the control unit 9 can determine the position of the yarn feeders at that time.

In FIG. 1, a so-called catcher nozzle 44 is disposed in the course of normal yarn travel during winding. A suction opening 45 of the catcher nozzle 44 is located behind the yarn travel path, above the yarn guide 13. The tube 46 of the catcher nozzle 44 and the tube 22 of the suction nozzle 21 are joined together by a common suction connection 47 communicated with the central negative pressure supply of the bobbin winding machine. A sensor 49 disposed in the common connection 47 immediately downstream of the junction 48 leading to the common connection 47, as viewed in the suction direction 40. Yarns that have been aspirated either by the suction nozzle 21 or by the catcher nozzle 44 and detected by the sensor 49 are reported to the control unit 9 over the signal line 49*a*.

Figure 2:
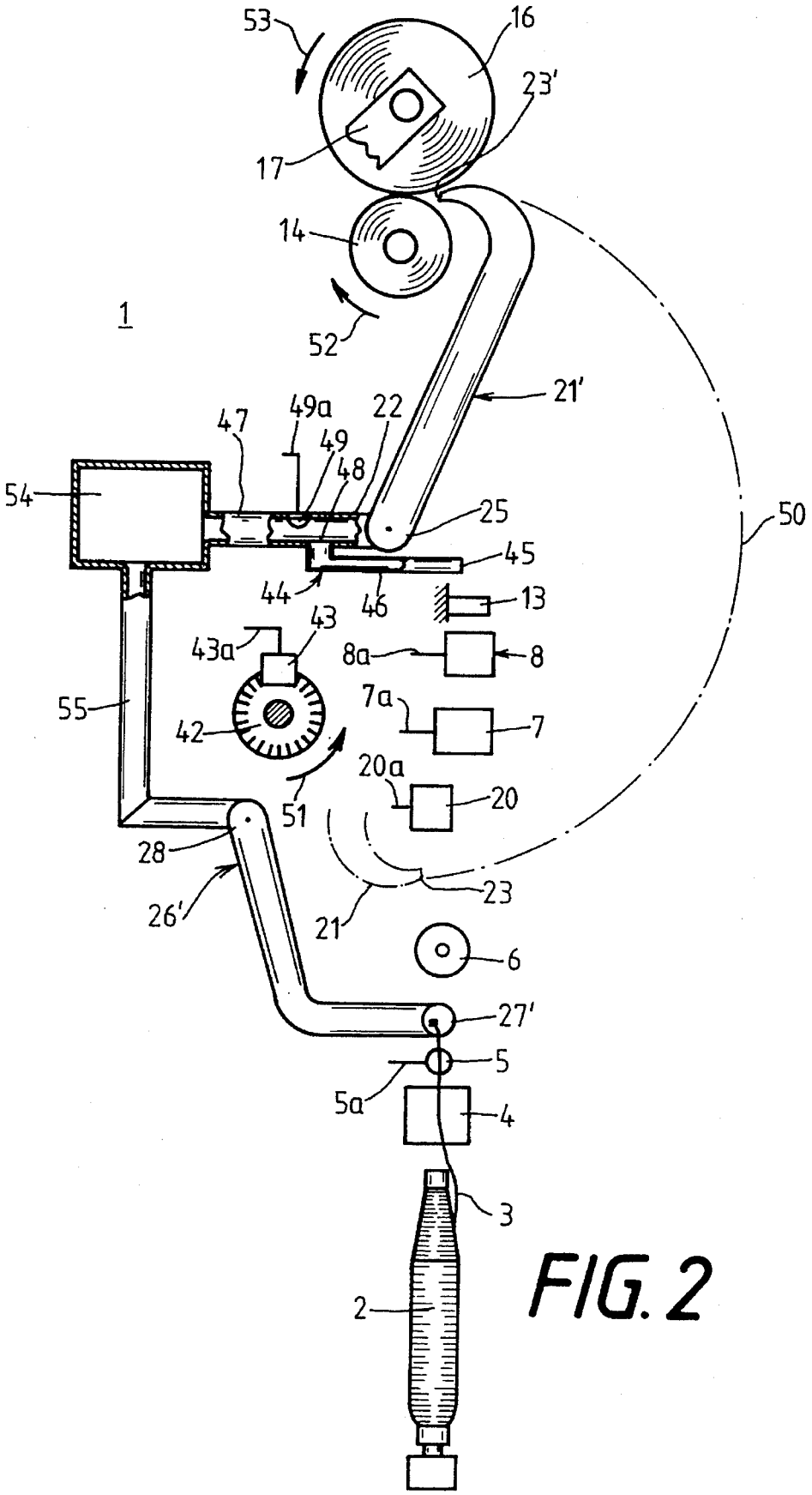
FIG. 2 is a schematic side view of the winding station of FIG. 1, with the suction nozzle in position in front of the take-up bobbin for aspirating its trailing yarn end, which has been entirely wound onto the take-up bobbin.

In FIG. 1, the normal path of travel by the yarn during an unimpeded bobbin winding process is shown. FIG. 2 shows the situation prevailing after a yarn interruption such as may be brought about by a yarn break or by cutting of the yarn in response to a yarn flaw.

The lower yarn end leading from the feed bobbin 2 has been grasped by the gripper tube 26 by pivoting thereof into the position 26' wherein the aspiration opening in the position 27' can receive and aspirate the yarn end. The lower yarn sensor 5 reports the presence of the lower yarn to the control unit 9 over the signal line 5*a* (FIG. 1). The sensor 49 downstream of the junction 48 of the suction nozzle 21 and the catcher nozzle 44 has been unable to find any yarn and has reported this to the control unit 9 over the signal line 49*a*. The cam disk packet 29 has thereupon been set into motion via the motor 33, causing the suction nozzle 21 to be pivoted upwardly from its retracted position over the semicircular path 50 into the position 21' to locate its aspiration opening 23 immediately adjacent the circumferential surface of the take-up bobbin 16. During this pivoting movement, the position of the suction nozzle 21 is monitored by means of the incremental signal encoder 42. During the pivoting, the disk 42 rotates in the direction of the arrow 51 (FIG. 2), and the increments are counted by the reading device 43. The suction nozzle 21 continues it pivotal movement into the position 21' unless the sensor 49 detects the presence of a yarn in the common connection 47 before a predetermined number of increments are counted corresponding to a certain angular position of the suction nozzle 21 which is also comparable to a determinable time after the cam packet is set into motion.

Upon detection of a yarn interruption, the take-up bobbin 16 is lifted from the winding roller 14 and braked to a standstill. Upon initiation of the pivoting movement of the suction nozzle 21, the take-up bobbin 16 is lowered back onto the winding roller 14. The winding roller 14 now rotates in the direction of the arrow 52, counter to the winding direction which drives the take-up bobbin 16 in the feeding direction 53. The yarn end that has been wound onto the circumferential surface of the take-up bobbin 16 is thereby exposed to the aspiration opening 23 to be aspirated in a known manner thereinto upon reaching the position 23'. This aspiration process can, in the manner known from DE 32 25 379 C2, be continued until such time as the sensor 49 detects a yarn end. Thereafter, the yarn end thusly aspirated can be placed in the yarn end joining device 20 by pivoting the suction nozzle 21 back out of its position 21' to its initial position, shown in dashed lines. The aspiration opening thereby carries the yarn end aspirated from the take-up bobbin along with it from the position 23' and on arriving at the original position 23 places this yarn end in the yarn end joining device 20.

As can also be seen from FIG. 2, a suction conduit 54 extends along all the winding stations of the bobbin winding machine. The common connection 47 to which the tube 23 of the suction nozzle 21 and the tube 46 of the catcher nozzle 44 are united discharges into this conduit. The suction connection 55 of the gripper tube 26 also discharges into the suction conduit 54. The gripper tube 26 is connected to the connection 55 via the swivel joint 28. By the described rotary motion, valves (not shown) are opened and closed, so that in the particular position of the gripper tube, suction is either applied or not applied to the suction opening 27.

Figure 3:
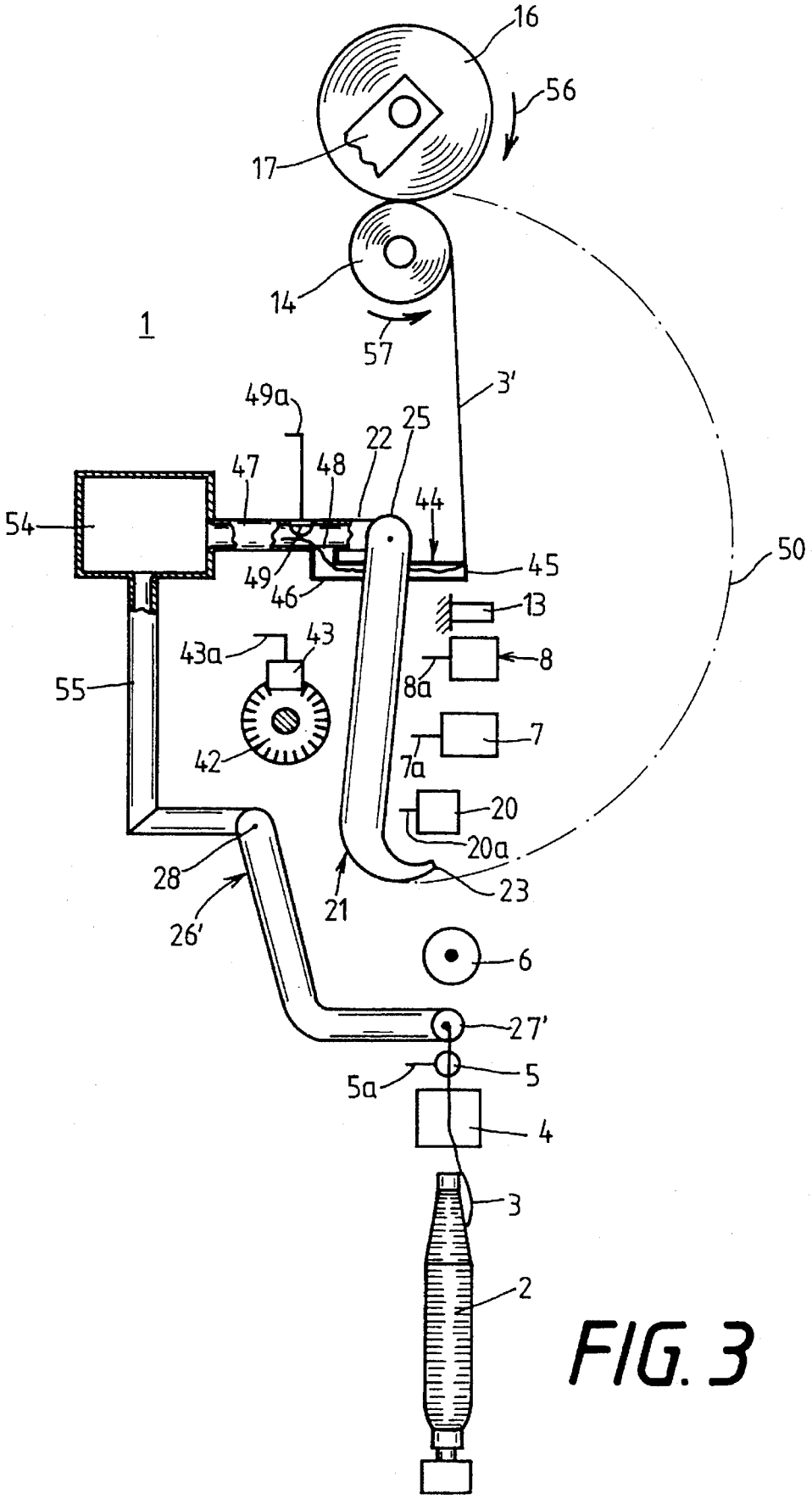
FIG. 3 is another schematic side view like FIG. 2, showing the winding station after a yarn break, with the upper yarn end trailing from the take-up bobbin having been aspirated by the catcher nozzle.

FIG. 3 shows the following incipient situation. After a yarn interruption, the yarn 3 coming from the feed bobbin 2 has been first properly clamped and cut in the cutting and clamping device 8 and then aspirated, after the opening of the clamping device 8 and yarn tensioner 6 by the aspiration opening 27 of the gripper tube 26 in the position 27'. The yarn end of the feed bobbin 2 is accordingly already located in the gripper tube 26.

The yarn end 3' of the take-up bobbin, conversely has been engaged by the catcher nozzle 44 and aspirated through its opening 45. It is detected by the sensor 49 downstream of the junction 48 of the suction nozzle 21 and catcher nozzle 44. Via the signal line 49*a*, a signal is output to the control unit 9 that a yarn has been aspirated via the catcher nozzle 44. In this situation, pivoting of the suction nozzle 21 in the direction of the take-up bobbin 16 along the circular path 50 thus would not lead to the engagement of the yarn end 3' by the aspiration opening 23 because the yarn end 3' is located in the yarn guide grooves of the winding roller 14 and therefore unable to be retrieved by suction through the aspiration opening. Rotating the take-up bobbin 16 in the unwinding direction would merely feed even more yarn into the catcher nozzle 44. Thus, before the yarn end joining operation can be initiated, the take-up bobbin 16 must first be driven in the winding direction 56 to withdraw the yarn end from the catcher nozzle 44. To that end, the take-up bobbin 16 is again placed onto the winding roller 14, which continues to rotate in the winding direction 57. The number of revolutions of the take-up bobbin 16 required to pull the yarn end 3' out of the catcher nozzle 44 and wind it completely onto the circumferential surface of the take-up bobbin 16 depends on the diameter of the take-up bobbin. To simplify the process from a control standpoint, however, a time can be specified or a number of revolutions, which is monitored by a signal transducer to ascertain incremental rotary motions, which transducer is comparable to the signal transducer 42 and which, not shown, may be disposed on the shaft 19 or on the creel 17. The requisite signals can thus be adapted to the smallest possible diameter of the take-up bobbin in such a way that the yarn will still be reliably pulled out of the catcher nozzle 44 and wound onto the circumferential surface of the bobbin 16. The yarn is more gently handled and the danger of pressing of the yarn end into the preceding yarn windings is less if the number of revolutions is specified as a function of the bobbin diameter already attained.

Not until it is assured that the yarn end 3' has been entirely pulled out of the catcher nozzle 44 and wound onto the circumferential surface of the take-up bobbin 16 can the yarn end joining operation be begun. This operation proceeds as known from the prior art, for instance as in DE 32 25 379 C2.

Figure 4:
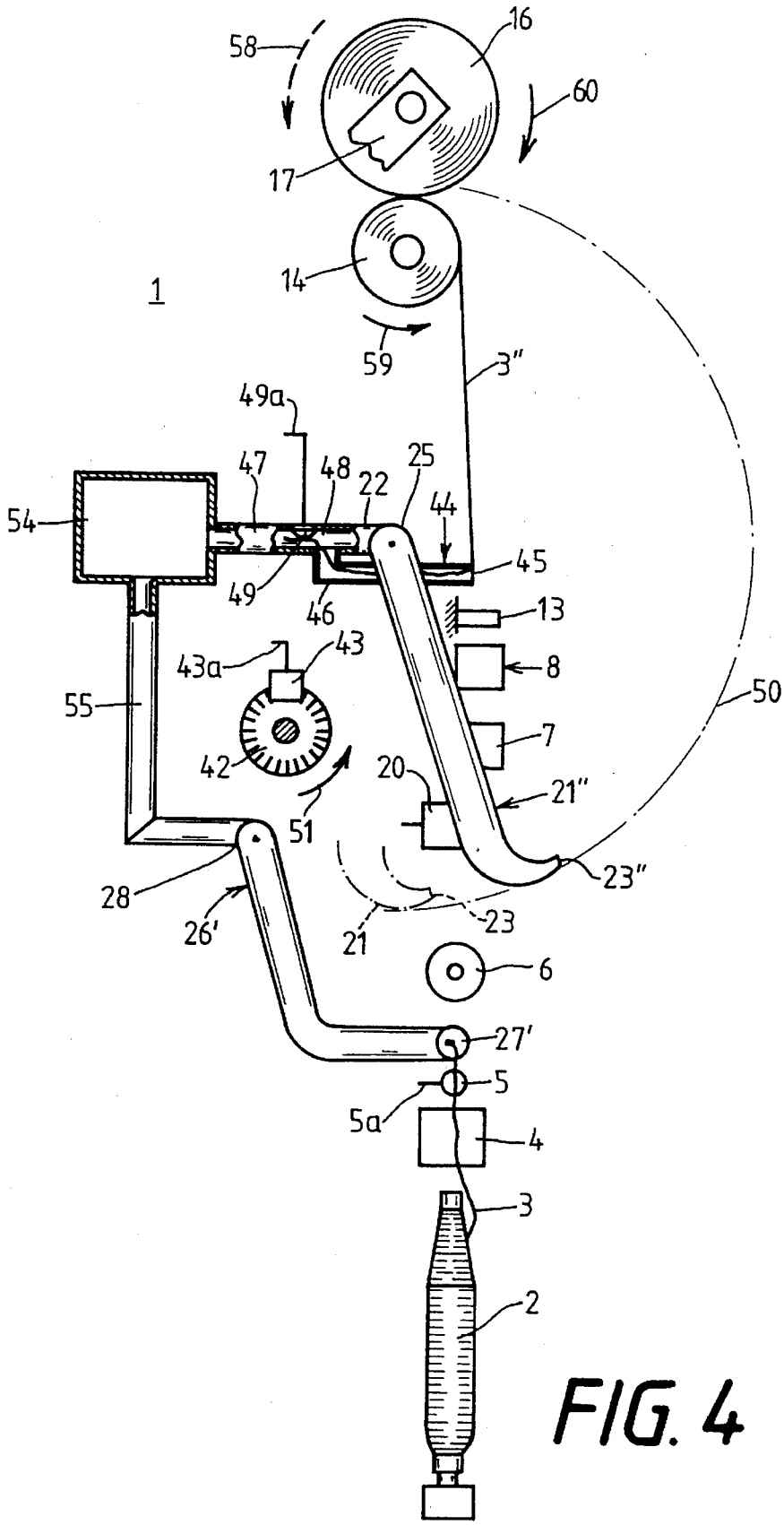
FIG. 4 is another schematic side view like FIG. 2 and FIG. 3, showing the finding of the yarn end in the catcher nozzle after a yarn end joining operation has been initiated.

FIG. 4 shows another situation as follows. After a yarn interruption, a situation of the kind described as the starting situation shown in FIG. 2 prevails initially. The sensor 49 in the common connection 47 to the negative pressure supply 54 does not detect any yarn. Via the control unit 9, a yarn end joining operation has thereupon been initiated. To that end, the suction nozzle 21 has been pivoted out of its retracted position. After having been stopped by raising from the winding roller 14, the take-up bobbin 16 is re-lowered onto the winding roller 14 and driven in the unwinding direction 58, as represented by the dashed arrow, which is intended to enable the aspiration opening 23 once pivoted into its upward position located in front of the circumferential surface of the take-up bobbin to aspirate the yarn end.

After the yarn interruption, however, the trailing end length of the yarn 3" was not wound as expected onto the circumferential surface of the take-up bobbin 16. Hence, while the take-up bobbin 16 rotates in the unwinding direction 58, the yarn end 3" is engaged by the catcher nozzle 44 and aspirated through the opening 45, after which the yarn end is detected by the sensor 49 at a point in time at which the suction nozzle 21 has only reached the intermediate position 21" which is still prior to the suction nozzle 21 reaching its predetermined upwardly pivoted angular position which the suction nozzle 21 must assume in order to aspirate the yarn so that it can be detected by the sensor 49 as having been aspirated by the suction nozzle 21. While the suction nozzle is being pivoted from the retracted position shown in broken lines in FIG. 4 to the intermediate position 21", the incremental signal encoder 42 also rotates in the direction of the arrow 51. From the signals counted during this pivoting motion, the control unit 9 can ascertain that it is not possible for the yarn recorded by the sensor 49 to be aspirated via the suction nozzle 21 and thus operates to stop the suction nozzle 21 from further pivoting movement. FIG. 4 shows the moment at which the control unit 9 has stopped the motion of the suction nozzle 21. The winding roller 14 has been stopped at the same time.

To make a yarn end joining operation possible, the winding roller 14 is now driven in the winding direction 59. As a result, the take-up bobbin 16 is likewise driven in the winding direction 60. The take-up bobbin 16 is now rotated until such time as the yarn end 3" has been pulled out of the catcher nozzle 44 and wound onto the take-up bobbin 16. The duration of winding of the yarn end 3" is effected in the way already described in conjunction with FIG. 3.

Figure 5:
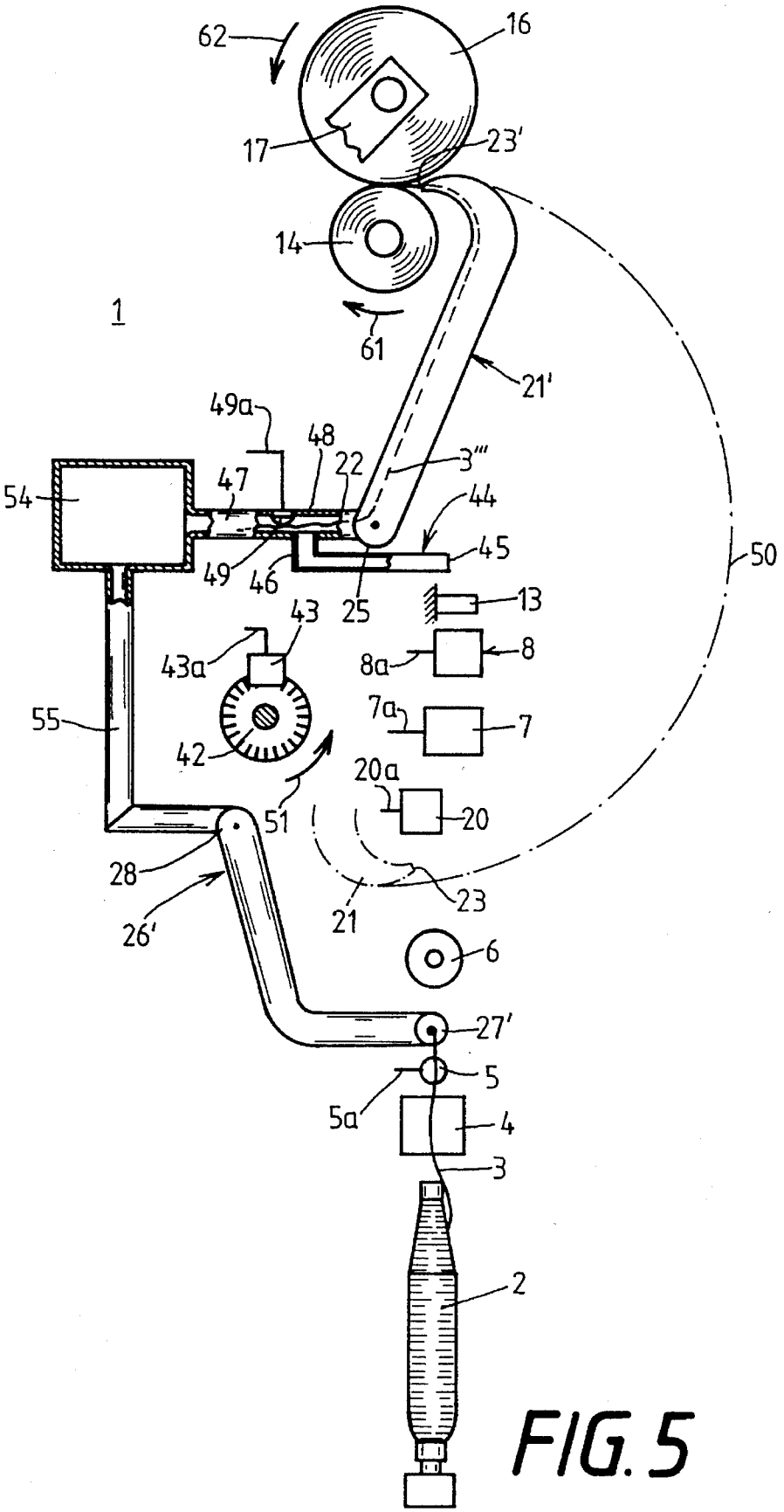
FIG. 5 is another schematic side view like FIGS. 2–4, showing the proper initiation of a yarn end joining operation in which the suction nozzle has aspirated the yarn end and the successful aspiration has been recorded by the sensor.

FIG. 5 shows a winding station 1 at the initiation of a yarn end joining operation, in which a yarn end has been successfully aspirated by the suction nozzle 21 in the aspirating position 21'. The precondition for the situation at the winding station as shown in FIG. 5 is either that the yarn end has already been wound onto the take-up bobbin, as described in conjunction with FIG. 2, or that, as a result of the operations responding to the situations described in conjunction with FIG. 3 and FIG. 4, the yarn end of the take-up bobbin aspirated by the catcher nozzle has been entirely wound onto the take-up bobbin.

Once the yarn end has been wound completely onto the take-up bobbin 16, the suction nozzle 21 pivots in a known manner into the upward aspirating position 21', so that the aspiration opening 23 is located in the position 23', in front of the circumferential surface of the take-up bobbin 16, ready for aspirating the yarn end. The winding roller 14 rotates in the direction of the arrow 61, counter to the winding direction, and thus drives the take-up bobbin 16 contacting it in the unwinding direction 62. Suction is applied to the aspiration opening 23 in the position 23', so that the yarn end located on the circumferential surface of the take-up bobbin 16 can be aspirated. As can be seen, the yarn end 3''' is depicted as having already been aspirated and detected by the sensor 49. The pulses output by a signal transducer on the bobbin or winding roller, which transducer is comparable to the signal transducer 42, are counted by a device comparable to the reading device 43.

If the sensor 49 has detected the yarn end aspirated by the suction nozzle 21 and has reported this to the control unit 9 over the signal line **49*a*, then the winding roller 14 is stopped from further rotation in the unwinding direction and thus the unwinding of the yarn end 3''' from the take-up bobbin 16 is also stopped. The suction nozzle located in the position 21' is then pivoted downwardly back into the starting position shown in dashed lines. In the process, the aspiration opening 23 carries the aspirated yarn end along with it and places it in the yarn end joining device 20. After that, the gripper tube 26 pivots upwardly out of its position 26' such that it can likewise place the feed yarn 3 that it holds into the yarn end joining device 20**. Once both yarn ends are located in the yarn end joining device, the yarn end joining takes place in a known manner, preferably by means of a splicing operation in the present exemplary embodiment. The severed yarn ends produced in the splicing are removed by suction from the yarn feeders. After that, the yarn feeders swivel back into their original retracted positions, and yarn travel is restored.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed:

1. In a process for winding a yarn at a winding station of a bobbin winding machine from a feed bobbin to a take-up bobbin rotating in a take-up direction, a method of correcting an interruption of yarn travel resulting in a trailing end of yarn from the take-up bobbin and a leading end of yarn from the feed bobbin, the method comprising the steps of:

stopping the take-up bobbin, sensing the absence of the trailing yarn end on the peripheral surface of the take-up bobbin, rotating the take-up bobbin briefly in the take-up direction to wind the trailing yarn end onto the peripheral surface of the take-up bobbin if the trailing yarn end is sensed to be absent from the peripheral surface of the take-up bobbin, suppressing the rotating of the take-up bobbin in the take-up direction once the trailing yarn end is on the peripheral surface of the take-up bobbin, aspirating the trailing yarn end from the peripheral surface of the take-up bobbin by means of a pivotable suction nozzle while rotating the take-up bobbin opposite to the take-up direction, and placing the aspirated trailing yarn end in a yarn end joining device for joining with the leading yarn end from the feed bobbin in order to restore yarn travel.

2. The method of claim 1, and further comprising the steps of:

transmitting a yarn-absent signal upon sensing the absence of the trailing yarn end on the peripheral surface of the take-up bobbin, measuring a predetermined time for which no yarn-absent signal is transmitted during said step of rotating the take-up bobbin in the take-up direction to wind the trailing yarn end onto the peripheral surface of the take-up bobbin, and then generating a yarn-present signal after the predetermined time for which no yarn-absent signal is transmitted, thereby indicating that the trailing yarn end is on the peripheral surface of the take-up bobbin.

3. The method of claim 1, and further comprising the steps of:

upon the interruption of yarn travel, moving the suction nozzle from a retracted position toward the peripheral surface of the take-up bobbin and rotating the take-up bobbin opposite the take-up direction so that the suction nozzle can aspirate the trailing yarn end;

continuing said step of sensing the absence of the trailing yarn end on the peripheral surface of the take-up bobbin during said moving of the suction nozzle;

monitoring the moving position of the suction nozzle relative to the take-up bobbin; and if the absence of the trailing yarn end is sensed in said sensing step and the suction nozzle is not within a predetermined distance from the take-up bobbin, then stopping said rotating of the take-up bobbin opposite the take-up direction, rotating for a predefined period of time the take-up bobbin in the take-up direction and then continuing said rotating the take-up bobbin opposite the take-up direction.

4. In an apparatus for winding a yarn at a winding station of a bobbin winding machine from a feed bobbin onto a take-up bobbin rotating in a take-up direction, means for correcting an interruption in yarn travel resulting in a yarn end trailing from the take-up bobbin and a yarn end leading from the feed bobbin, the correcting means comprising:

control means Operable after a yarn interruption for controlling the direction of rotation of the takeup Bobbin;

a suction nozzle movable to adjacent the take-up bobbin for aspirating the trailing yarn end from the peripheral surface of the take-up bobbin and for placing it in a yarn end joining device for joining it to the leading yarn end from the feed bobbin in order to restore yarn travel, a catcher nozzle for aspirating the trailing yarn end from a disposition thereof which is not on the peripheral surface of a take-up bobbin, and a sensor associated with the catcher nozzle for detecting the presence of the trailing yarn end within the catcher nozzle to thereby indicate to said control means the absence of the trailing yarn end on the peripheral surface of the take-up bobbin, said control means being operative for rotating the take-up bobbin in the take-up direction when said sensor detects the trailing yarn end within said catcher nozzle in order to wind the trailing yarn end onto the peripheral surface of the take-up bobbin.

5. The apparatus of claim 4, wherein the catcher nozzle and the movable suction nozzle are joined at a junction leading to a common connection to a negative pressure supply, and the sensor is located downstream in the suction direction from the junction.

6. An apparatus according to claim 4, wherein said catcher nozzle is fixed, and wherein said control means controls the movement of said suction nozzle and controls rotation of the take-up bobbin in the take-up direction when said sensor detects the trailing yarn end within said catcher nozzle before said suction nozzle is moved within a predetermined distance from said take-up bobbin for said aspiration of the yarn end.

7. An apparatus according to claim 4, wherein the length traveled by the trailing yarn end through said suction nozzle to said sensor is longer than the length traveled by the trailing yarn end through said catcher nozzle to said sensor.

* * * * *